US012576322B1

(12) United States Patent
Troiano et al.

(10) Patent No.: US 12,576,322 B1
(45) Date of Patent: Mar. 17, 2026

(54) FOLDABLE BALL THROWING DEVICE, WITH LIGHT CHARGING OF A GLOW-IN-THE-DARK BALL

(71) Applicant: Gramercy Products, LLC, Secaucus, NJ (US)

(72) Inventors: Daniel Troiano, Huntington, NY (US); Louis Henry, Scarsdale, NY (US); Marc Sharrer, Nyack, NY (US)

(73) Assignee: Gramercy Products, LLC, Secaucus, NJ (US)

( * ) Notice: Subject to any disclaimer, the term of this patent is extended or adjusted under 35 U.S.C. 154(b) by 0 days.

(21) Appl. No.: 18/916,813

(22) Filed: Oct. 16, 2024

Related U.S. Application Data

(60) Provisional application No. 63/624,844, filed on Jan. 25, 2024.

(51) Int. Cl.
*A63B 65/00* (2006.01)
*A63B 65/12* (2006.01)

(52) U.S. Cl.
CPC ..... *A63B 65/122* (2013.01); *A63B 2210/50* (2013.01); *A63B 2225/74* (2020.08)

(58) Field of Classification Search
CPC .... A01K 15/027; A01K 15/02; A63B 65/122; A63B 2210/50; A63B 2225/74
USPC ..... 119/702, 707; D21/722–724; D30/160; 473/505, 509
See application file for complete search history.

(56) References Cited

U.S. PATENT DOCUMENTS

| | | | |
|---|---|---|---|
| 491,558 | A | 2/1893 | Hill |
| 1,175,035 | A | 3/1916 | Wooster |
| 1,535,029 | A | 4/1925 | Murch |
| 1,585,446 | A | 5/1926 | Warwick |
| 3,206,202 | A | 9/1965 | Evans |
| 3,428,036 | A | 2/1969 | Parker |

(Continued)

FOREIGN PATENT DOCUMENTS

| | | |
|---|---|---|
| CN | 103314870 | 9/2013 |
| GB | 2 385 537 | 8/2003 |

(Continued)

OTHER PUBLICATIONS

Press Fit Engineering and Design Calculator, Engineers Edge, available at: www.engineersedge.com/calculators/machine-design/press-fit/press-fit-calculator.htm.

*Primary Examiner* — Richard T Price, Jr.

(74) *Attorney, Agent, or Firm* — Thomas A. O'Rourke; James Bongiorno; O'Rourke IP Law, PLLC

(57) ABSTRACT

A ball thrower includes: first and second arms and a sleeve. The first arm has a graspable handle at a first end, hinge knuckle(s) proximate to a second end; and a shaped prong. The second arm has a hinge knuckle(s) at its first end, a ball holder at its second end; and a shaped recess. The hinge knuckle(s) of the first arm pivotally couple to hinge knuckle(s) of the second arm, being pivotable between collapsed and extended positions. The shaped prong is complementary in shape to the shaped recess, and nest together with the second arm in the extended position. The sleeve slides on the second arm to overlay and frictionally engage the selectively shaped prong and an adjacent portion of the second arm, at a position proximate to, but displaced from the hinge knuckles. Light sources in the ball holder light charge a glow-in-the-dark ball.

16 Claims, 13 Drawing Sheets

(56) References Cited

U.S. PATENT DOCUMENTS

| | | | | |
|---|---|---|---|---|
| 3,589,349 | A | 6/1971 | Parker | |
| 3,841,292 | A | 10/1974 | Hoffman | |
| 4,746,119 | A | 5/1988 | Jeanrot | |
| 4,974,574 | A | 12/1990 | Cutlip | |
| 5,390,652 | A | 2/1995 | Minneman | |
| 5,423,543 | A | 6/1995 | Tarrant | |
| 6,076,829 | A | 6/2000 | Oblack | |
| 6,477,745 | B2 | 11/2002 | Strebl | |
| 7,032,583 | B1 | 4/2006 | Hall | |
| D624,712 | S | 9/2010 | McCann | |
| 7,815,429 | B1 | 10/2010 | Clark | |
| D634,489 | S | 3/2011 | Page | |
| 7,900,617 | B1 | 3/2011 | Keersh | |
| D637,248 | S | 5/2011 | Levin | |
| 8,028,684 | B1 | 10/2011 | Weissmann | |
| D664,722 | S | 7/2012 | McCann | |
| D674,851 | S | 1/2013 | Osborne | |
| 8,418,681 | B2 | 4/2013 | Levin | |
| 8,517,003 | B2 | 8/2013 | Fisher | |
| 8,720,385 | B2 | 5/2014 | Tanner | |
| 8,857,419 | B2 | 10/2014 | Hansen | |
| 8,973,564 | B1 | 3/2015 | Saber | |
| 9,149,695 | B2 | 10/2015 | Evans | |
| D758,511 | S | 6/2016 | Williams | |
| D759,907 | S | 6/2016 | Weinstein | |
| 9,392,768 | B1 * | 7/2016 | Mullin | F41B 3/04 |
| D782,588 | S | 3/2017 | Fryer | |
| D782,752 | S | 3/2017 | Knepper | |
| 9,623,304 | B2 | 4/2017 | Clarke | |
| 9,656,136 | B2 | 5/2017 | Van Alen | |
| 9,757,632 | B2 | 9/2017 | Fryer | |
| 10,150,022 | B1 | 12/2018 | Robino | |
| D953,664 | S | 5/2022 | Wilhelm | |
| 11,547,090 | B2 * | 1/2023 | Yang | A01K 15/025 |
| 11,895,755 | B2 | 2/2024 | Rebernig | |
| 12,082,555 | B2 * | 9/2024 | Wilhelm | A01K 15/025 |
| 12,108,740 | B2 * | 10/2024 | Wilhelm | A01K 15/025 |
| 2004/0029656 | A1 | 2/2004 | Vannoy | |
| 2005/0263962 | A1 | 12/2005 | Roh | |
| 2006/0281574 | A1 | 12/2006 | Winchester | |
| 2007/0277746 | A1 | 12/2007 | Piaget | |
| 2008/0004140 | A1 | 1/2008 | Matsumoto | |
| 2008/0072885 | A1 | 3/2008 | Fitt | |
| 2008/0127955 | A1 | 6/2008 | Christ | |
| 2008/0261732 | A1 | 10/2008 | Mullin | |
| 2009/0025699 | A1 | 1/2009 | Mongkolkasetarin | |
| 2009/0120419 | A1 | 5/2009 | Simon | |
| 2010/0018510 | A1 | 1/2010 | Shoaff | |
| 2010/0078003 | A1 | 4/2010 | Young | |
| 2010/0203987 | A1 | 8/2010 | Bagley | |
| 2011/0017184 | A1 | 1/2011 | Henry | |
| 2012/0042860 | A1 | 2/2012 | McCann | |
| 2012/0048251 | A1 | 3/2012 | Oblack | |
| 2012/0227721 | A1 | 9/2012 | Geller | |
| 2012/0312286 | A1 | 12/2012 | Kilian | |
| 2013/0165278 | A1 | 6/2013 | Butterfield | |
| 2013/0186381 | A1 | 7/2013 | Hansen | |
| 2015/0090237 | A1 | 4/2015 | Williams | |
| 2015/0342146 | A1 | 12/2015 | Tucker | |
| 2016/0096092 | A1 | 4/2016 | Williams | |
| 2016/0213990 | A1 | 7/2016 | Mamanguun | |
| 2017/0001087 | A1 | 1/2017 | Parness | |
| 2017/0284764 | A1 | 10/2017 | Mellen | |
| 2018/0117433 | A1 | 5/2018 | Scott | |
| 2021/0259209 | A1 | 8/2021 | Wilhelm | |

FOREIGN PATENT DOCUMENTS

| | | |
|---|---|---|
| WO | WO 2015/176324 | 11/2015 |
| WO | WO 2017/129993 | 1/2016 |
| WO | WO 2021/167782 A1 | 8/2021 |

* cited by examiner

FOLDABLE BALL THROWING DEVICE, WITH LIGHT CHARGING OF A GLOW-IN-THE-DARK BALL

CROSS-REFERENCES

This application claims priority on U.S. Provisional Patent Application Ser. No. 63/624,844, filed on Jan. 25, 2024, the disclosures of which are incorporated herein by reference.

FIELD OF THE INVENTION

The present invention relates generally to a device for launching a ball over distances greater than may be achieved solely by use of the person's hand and arm, and more particularly relates to a foldable ball throwing device also configured to particularly emit light to quickly and thoroughly charge a glow-in-the-dark ball used therewith for a nighttime game of fetch with a pet.

BACKGROUND OF THE INVENTION

The game of fetch is played with different animals, particularly with a dog. The game may be enjoyed by both the pet and the pet owner. The game of fetch may also simultaneously provide exercise for the animal. The game is played using an object, typically a stick or a ball, and sometimes a Frisbee, which may be held by the pet owner and thrown or spun a significant distance away, to provide a greater amount of exercise and reduce the number of tosses to achieve such exercise. The pet owner may also say the word "fetch" to indicate the game is being played, and familiarize the pet with a command that will be used to indicate that the object is to be retrieved. The game is instinctively played by many dogs; however, other pets may need some help in learning the command to not only run after the thrown object, but to retrieve it as well.

Since many dogs can play the game for long periods of time, which may be tiresome for the pet owner, particularly when trying to fling the object far away so that dog needs to run farther, devices have been developed to aid such pet owners. Many such devices use a ball to play the game, as it allows it to be launched greater distances due to its ability to roll and bounce.

Many devices have been developed to accomplish such ball-throwing activity, as shown by the following U.S. Patents and Published Patent Applications: U.S. Pat. No. 6,477,745 to Strebl; U.S. Pat. No. 8,418,681 to Levin; U.S. Pat. No. 8,517,003 to Fisher; U.S. Pat. No. 8,720,385 to Tanner; U.S. Pat. No. 8,857,419 to Hansen; U.S. Pat. No. 9,392,768 to Mullin; D637,249 to Levin; D674,851 (Osborne); D758,511 to Williams; D759,907 to Weinstein; 2012/0048251 (Oblack); 2008/004140 (Matsumoto); 2008/0072885 (Fitt); 2009/0025699 (Mongkolkasetarin); 2012/0186381 (Hansen); 2013/0165278 (Butterfield); and 2015/0342146 (Tucker).

The present invention offers advantages over these and other prior art ball launching devices.

It is noted that the citing of any reference within this disclosure, i.e., any patents, published patent applications, and non-patent literature, is not an admission regarding a determination as to its availability as prior art with respect to the herein disclosed and claimed method/apparatus.

OBJECTS OF THE INVENTION

It is an object of the invention to provide a device that may launch a ball or other object over a distance that may be greater than may otherwise be achieved through the use of only the person's hand and arm.

It is another object of the invention to provide a ball throwing device that is foldable for ease of storing and transport of the device.

It is a further object of the invention to provide a ball throwing device that is configured to quickly charge a glow-in-the-dark ball with visible light.

It is another object of the invention to provide a ball throwing device that is configured to emit visible light to quickly charge a glow-in-the-dark ball, and which automatically shuts off the light within a threshold amount of time.

It is a further object of the invention to provide a ball throwing device that is configured to emit visible light along a series of different non-parallel axes to more effectively, and thus more quickly, charge a glow-in-the-dark ball, and which device is water-proof to permit its use in the rain.

It is yet another object of the invention to provide a ball throwing device configured to emit visible light quickly and fully charge a glow-in-the-dark ball, and which device is configured to fold for convenient storage when not in use.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION OF THE INVENTION

Figure 2:
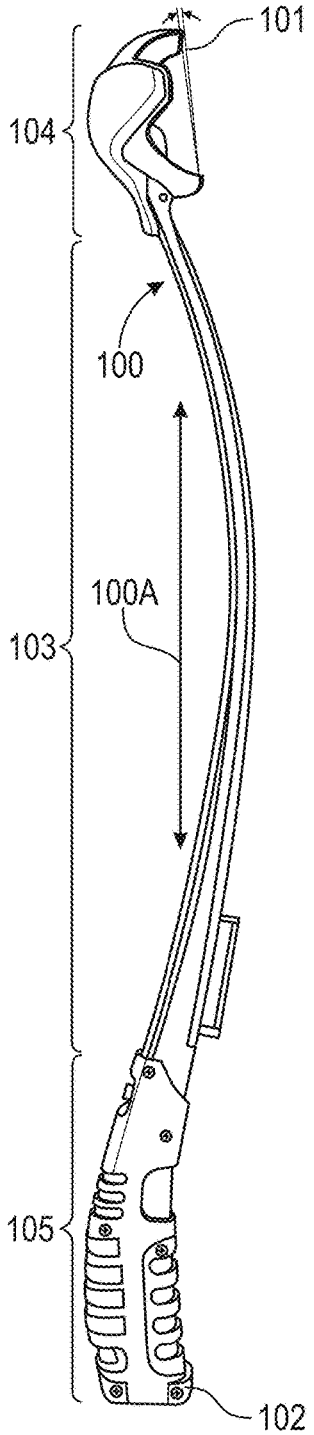
FIG. 2 is a left-side view of the ball launching device of FIG. 1.
Figure 1:
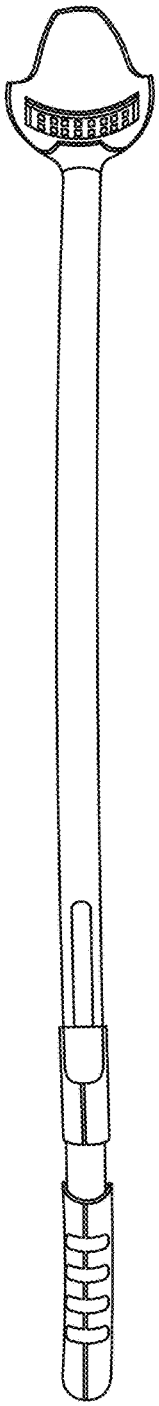
FIG. 1 is a front view of a ball launching device disclosed herein.
Figure 3:
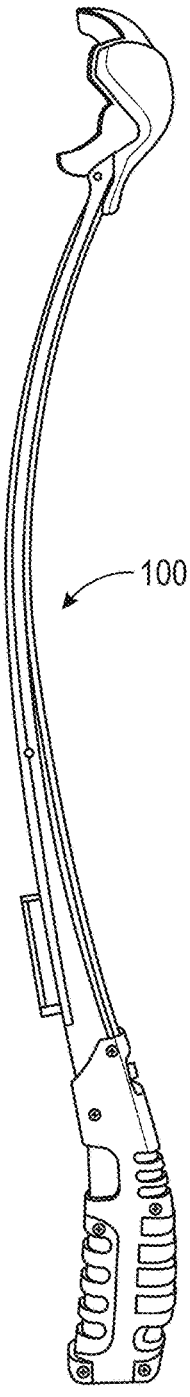
FIG. 3 is a right-side view of the ball launching device of FIG. 1.
Figure 4:
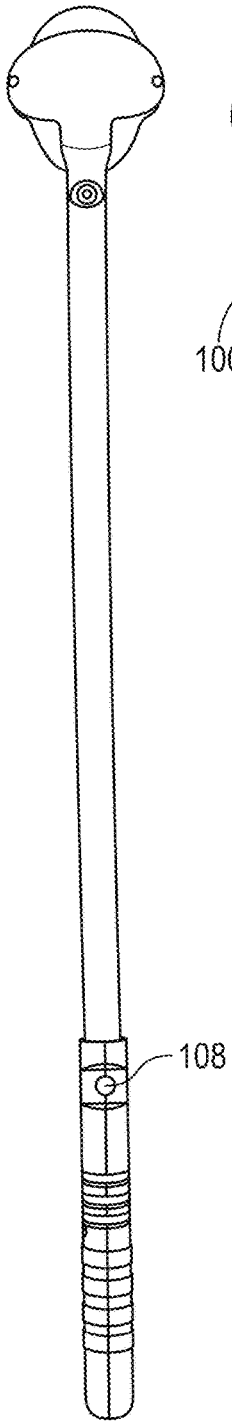
FIG. 4 is a rear view of the ball launching device of FIG. 1.
Figure 1A:
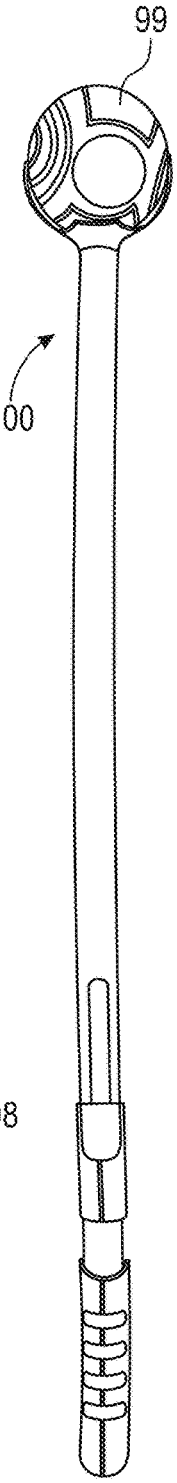
FIG. 1A is the front view of the ball launching device as seen in FIG. 1, but is shown after a glow-in-the-dark ball has been releasably received in the light-charging cradle portion of the device.
Figure 5:
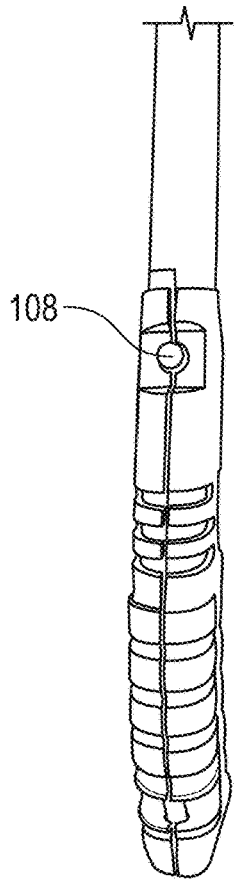
FIG. 5 is the right-side view of the ball launching device as seen in FIG. 4, but shown enlarged to highlight the handle portion and the light activation button.

As used throughout this specification, the word "may" is used in a permissive sense (i.e., meaning having the potential to, or being optional), rather than a mandatory sense (i.e., meaning must), as more than one embodiment of the invention may be disclosed herein. Similarly, the words "include", "including", and "includes" mean including but not limited to.

The phrases "at least one", "one or more", and "and/or" may be open-ended expressions that are both conjunctive and disjunctive in operation. For example, each of the expressions "at least one of A, B and C", "one or more of A, B, and C", and "A, B, and/or C" herein means all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, it is noted that the citing of any reference within this disclosure, i.e., any patents, published patent applications, and non-patent literature, is not an admission regarding a determination as to its availability as prior art with respect to the herein disclosed and claimed apparatus/method.

Furthermore, any reference made throughout this specification to "one embodiment" or "an embodiment" means that a particular feature, structure or characteristic described in connection therewith is included in at least that one particular embodiment. Thus, the appearances of the phrases "in one embodiment" or "in an embodiment" in various places throughout this specification are not necessarily all referring to the same embodiment. Therefore, the described features, advantages, and characteristics of any particular aspect of an embodiment disclosed herein may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value or recitation modified by a term such as "about" is not to be limited to the precise theoretical characteristic or value specified, and may include values that differ from the specified value in accordance with design variations that may be described in the specification, as well as applicable case law. Also, in at least some instances, a numerical difference provided by the approximating language may correspond to the precision of an instrument that may be used for measuring the value or characteristic (e.g., a recitation of being "substantially straight"). A numerical difference provided by the approximating language may also correspond to a manufacturing tolerance associated with production of the aspect/feature being quantified/described (see e.g., *Ex Parte Ollmar*, Appeal No. 2014-006128 (PTAB 2016)). Furthermore, a numerical difference provided by the approximating language may also correspond to an overall tolerance for the aspect/feature that may be derived from variations resulting from a stack up (i.e., the sum) of a multiplicity of such individual tolerances.

Similarly, the term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Any use of a friction fit (i.e., an interface fit) between two mating parts described herein indicates that the opening (e.g., a hole) is smaller than the part received therein (e.g., a shaft), which may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole/recess) is larger than the part received therein (e.g., a shaft/protrusion), enabling the two parts to move (e.g. to slide and/or rotate) when assembled, where the gap between the opening and the part may depend upon the size of the part and the type of clearance fit—i.e., loose running, free running, easy running, close running, and sliding (e.g., for a 0.1250 inch shaft diameter the opening may be 0.1285 inches for a close running fit, and may be 0.1360 inches for a free running fit; for a 0.5000 inch diameter shaft the opening may be 0.5156 inches for a close running fit and may be 0.5312 inches for a free running fit). Other clearance amounts are used for other clearance types. See "Engineering Fit" at: en.wikipedia.org/wiki/Engineering_fit; and "Three General Types of Fit," available at mmto.org/~dclark/Reports/Encoder%20Upgrade/fittolerences %20%5BRead-Only%5D.pdf.

Any structures or methods described herein with respect to two elements being fixedly secured together means that any suitable joining technique known in the art may be used, including, but not limited to, using mechanical fasteners (e.g., rivets, screws, bolts & nuts, nails, threaded inserts, knock-down fittings, etc.), adhesive, welding techniques (arc welding, friction welding, etc.), interference fits between mating parts, etc.

FIGS. 1-8 illustrate various views of a ball throwing device 100. The ball throwing device 100 may extend from a first end 101 to a second end 102, and may generally be formed to include an elongated arm portion 103 that may transition into, or have fixedly secured thereto, a ball holder/cradle 104, and may also transition into, or have fixedly secured thereto, a hand-graspable handle-portion 105.

The ball holder 104 may have an interior surface 1041 that may be formed to match a portion of the spherical shape of the ball to be received therein, which may be retained in a friction fit. In one embodiment, in order for the ball to be positively retained, the interior surface 1041 of the ball holder 104 may extend to be just slightly greater than 180 degrees of arc (see FIG. 2), so that some slight deformation of the circumferential lip of the ball holder may be needed to release the ball, when the device is used to throw the ball held in the ball holder. To limit the total amount of deformation that may be needed for the ball's release, which may otherwise detract from the distance that the ball may be thrown using the device, the distal open end of the ball holder 104 may be scalloped to form a plurality of finger regions (e.g., four finger regions: 104Fi, 104Fii, 104Fiii, 104Fiv) that may just provide a sufficient retaining force be able to retain the ball therein in a slight friction fit, even when inverted with the ball facing down towards the ground. Other shapes for releasably supporting the ball may alternatively be used.

The elongated arm 103 and the handle portion 105 may be integrally formed as a single unitary piece, or may alternatively be formed as separate parts that may be fixedly secured together. It should be noted that all three portions—the elongated arm portion 103, the ball holder 104, and the handle portion 105—may be integrally formed as a single unitary part.

Figure 6:
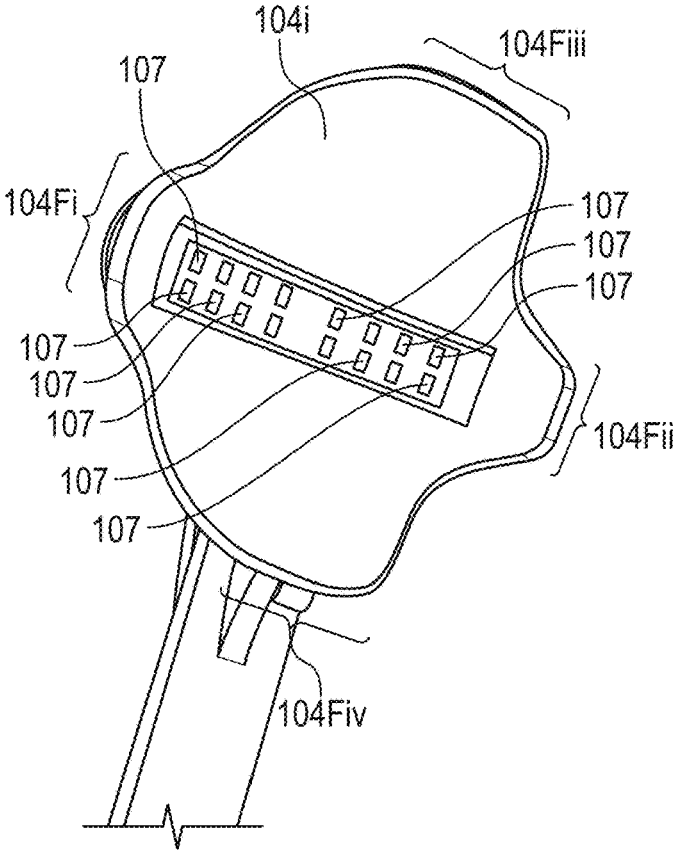
FIG. 6 is an enlarged perspective view of the cradle-portion of the ball launching device of FIG. 1, showing an LED array positioned therein.
Figure 7:
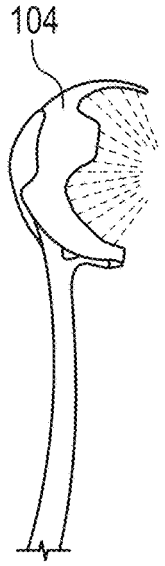
FIG. 7 is an enlarged left-side view of the cradle-portion of the ball launching device of FIG. 1, but is shown after the light activation button has been toggled to cause the plurality of radially oriented LEDs to illuminate.
Figure 8:
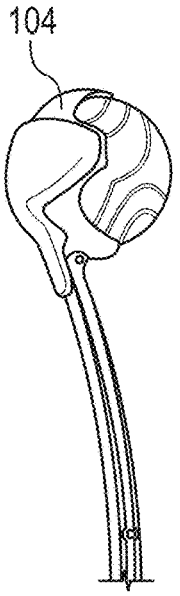
FIG. 8 is an enlarged left-side view of the cradle-portion of the ball launching device of FIG. 1, but is shown after a glow-in-the-dark ball has been received in the light-charging cradle-portion of the device.
Figure 9:
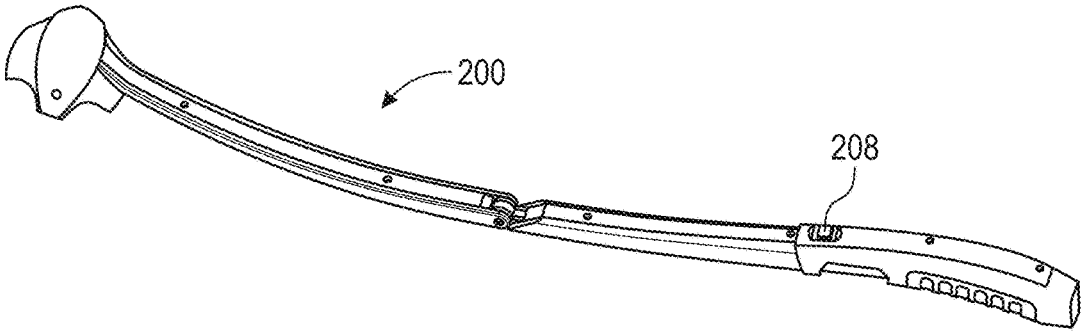
FIG. 9 is a rear perspective view of a ball launching device disclosed herein, showing a narrowed region of one of the elongated arm portions adjacent to the hinge.
Figure 10:
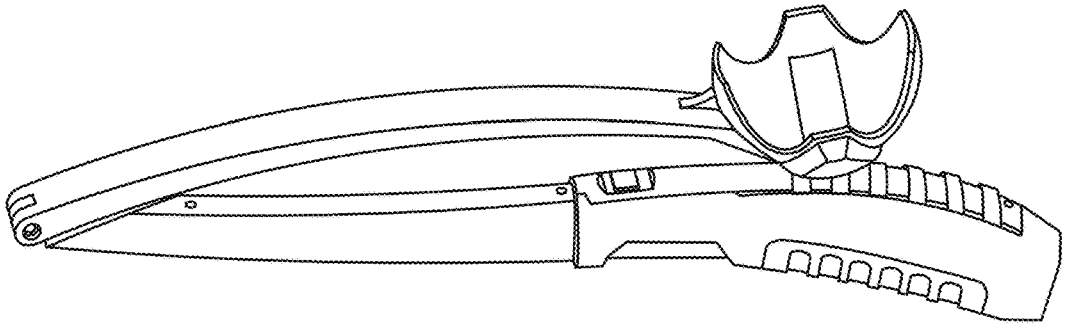
FIG. 10 is another perspective view of the ball launching device of FIG. 9, but is shown with the device in a folded position.
Figure 11:
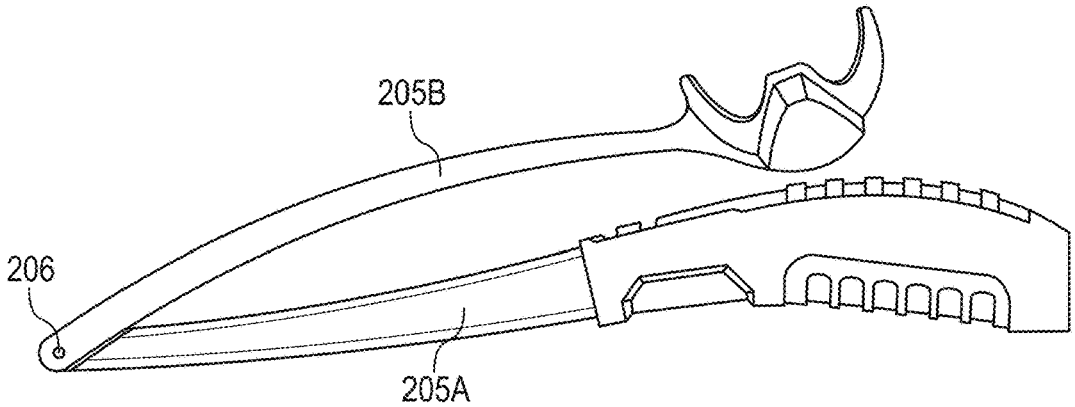
FIG. 11 is a side view showing the ball launching device of FIG. 9 in a folded position.
Figure 12:
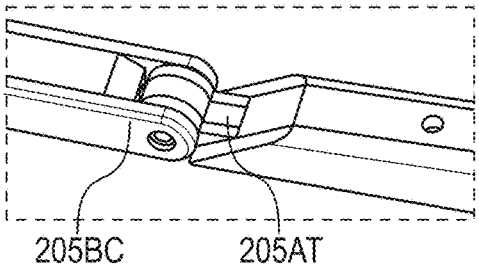
FIG. 12 is an enlarged perspective view showing the front of the hinged portion of the ball launching device of FIG. 9.
Figure 13:
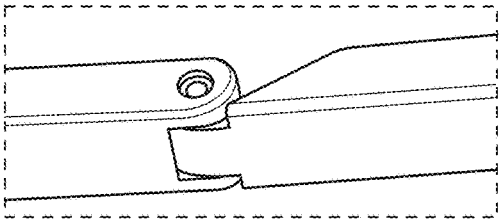
FIG. 13 is an enlarged perspective view showing the rear of the hinged portion of the ball launching device of FIG. 9.
Figure 14:
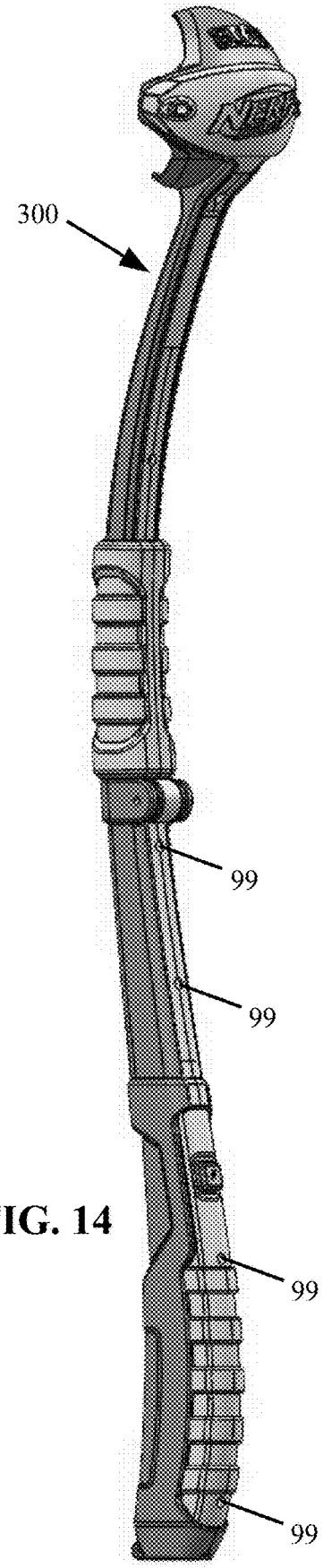
FIG. 14 is a perspective view of another embodiment of a ball launching device as disclosed herein, which includes a ball holder configured to light charge a glow in the dark ball, and a hinge to permit collapsing of the ball thrower for ease of storage.

As best seen in FIG. 6, the ball holder 104 may be formed to include a plurality of light sources 107, which light sources are not limited to, but which may preferably be, LEDs rather than incandescent lights. The LEDs 107 may be individually positioned in a recess 104R formed in the ball holder 104. The LEDs 107 may also be positioned onto a strip that may be received in the recess 104R and may be secured therein to a portion of the ball holder 104. Either arrangement may utilize a single row of LEDs 107, or may instead utilize two rows (i.e., pairs) of LEDs 107, or three or more rows. The row or rows of LEDs 107 may extend across a substantial portion of the ball holder, e.g., extending from proximity to the first finger 104Fi to proximity to the second finger region 104Fii, as seen in FIG. 6. The row or rows of LEDs 107 may extend across the spherical surface of the ball holder 104 perpendicularly with respect to the axial direction 100A of the elongated arm 103 (as seen in FIG. 6), or may alternatively extend in generally the same direction as the axial direction of the elongated arm, i.e., from the third finger region 104Fiii to the fourth finger region 104Fiv, as seen generally in FIG. 6. Alternatively, there may be rows of LEDs that extend in both directions to form a cross-shaped pattern of lights (not shown). The LEDs may be positioned to produce a series of different axes of light that would create a dispersion of light (a light pattern) that would tend to direct light into various different portions of the ball, as may be understood from the light emission pattern seen in FIG. 6. To exhibit a glow-in-the-dark characteristic, and to possess light charging capability, the ball utilized may contain a phosphor that may be energized by normal light, and which may have a very long persistence. Two such phosphors that tend to be utilized are Zinc Sulfide and Strontium Aluminate. Strontium Aluminate.

The light sources 107 may be powered by rechargeable batteries that may preferably be stored in the handle portion 105. Activation of the light sources 107 may be controlled through the use of a switch that is activated by a button 108, which button may be ergonomically positioned in the handle portion 105 so that it may be actuated by the user's thumb while simultaneously holding a portion of the handle between the palm and the other four fingers. The switch may also be coupled to a timer so that once the button 108 is toggled, the light sources 107 may be powered on for only a threshold period of time that may be sufficient to fully charge the ball, e.g., 20 seconds, or 30 seconds, or 40 seconds, etc. Alternatively, the button 108 may need to be toggled once to turn on the light sources 107 and be toggled a second time to turn off the lights.

All of the electronics of the ball throwing device 100 may be waterproofed sufficiently, so that the device may be used in the rain, without failure of the light charging capability. Moreover, the waterproofing may be sufficient to permit the entire array of light sources 107 of the ball holder 104 to be submerged under water, without any affect upon its operational capability.

As seen in FIGS. 9-13, a ball throwing device 200 may be formed the same as ball throwing device 100, but which may also include a hinge arrangement. The ball throwing device 200 may be formed to include a first handle portion 205A and a second handle portion 205B, which may respectively be formed with a tongue 205AT and clevis 205BC, which may be pivotally coupled together using a hinge pin 206. The hinge arrangement may be formed to permit transmission of electrical signals from the button 208 to the array of light sources of the ball holder. See e.g., U.S. Pat. No. 4,140,357 to Wolz, and U.S. Pat. No. 4,412,711 to Suska.

As seen in FIGS. 14-31, a ball throwing device 300 may be formed similar to ball throwing device 200, but which may also include at least a different hinge arrangement, and a different electrical coupling arrangement across the two arms, and may thus be constructed with different features in its component parts.

Figure 15:
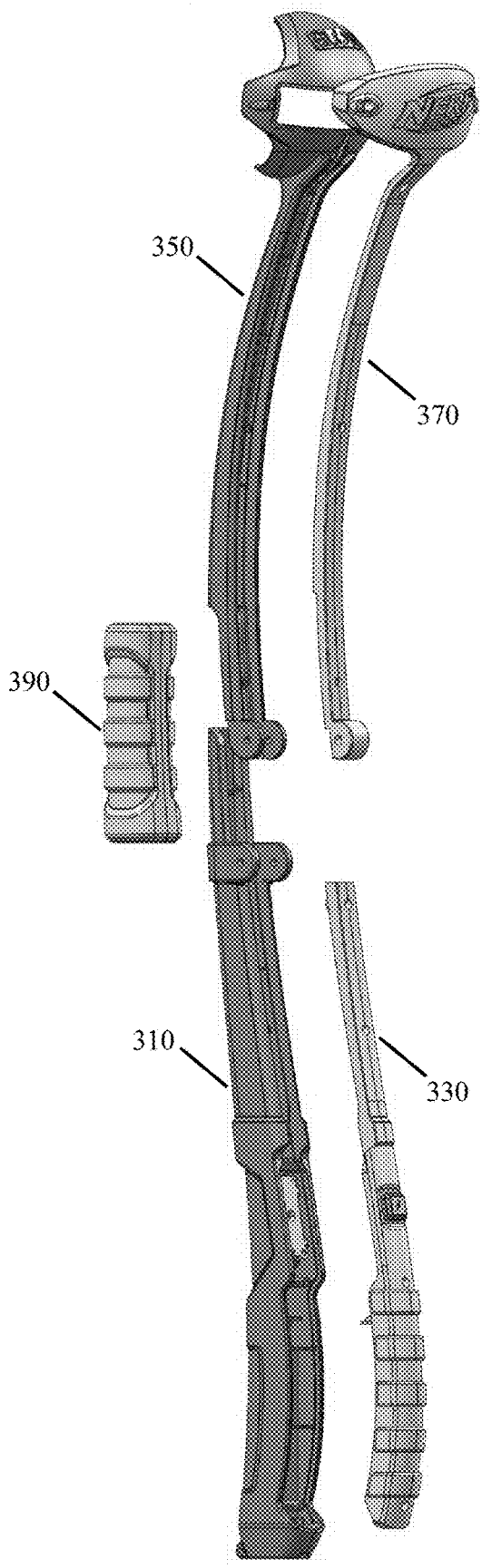
FIG. 15 is an exploded perspective view showing the five main component parts of the ball launching device of FIG. 14.
Figure 16:
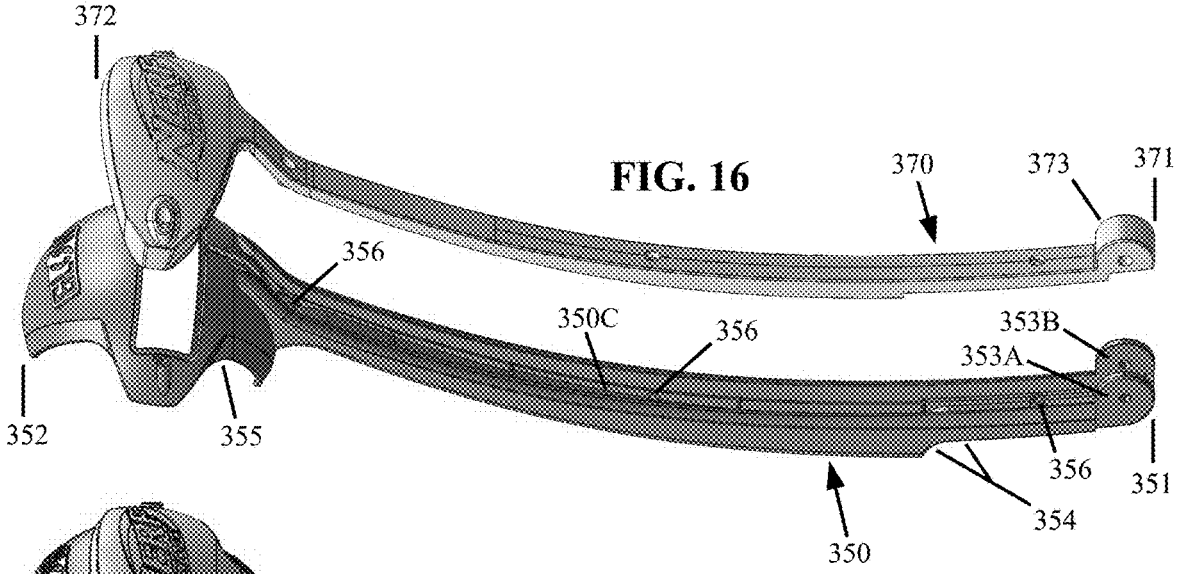
FIG. 16 is a side perspective view showing the two component parts that may be secured together to form one of the arms of the ball throwing device of FIG. 14, which include a ball holder.

As seen in FIG. 15, the ball throwing device 300 may be formed of five main component parts, a first arm member 310, a first arm cover 330, a second arm member 350, a second arm cover 370, and a sleeve 390. Note that the first arm member 310 and the first arm cover 330 may alternatively be formed as a single unitary part, but are instead shown formed as two separate parts as that may facilitate ease of manufacturing, and the same is true with respect to the second arm member 350 and second arm cover 370.

Figure 18:
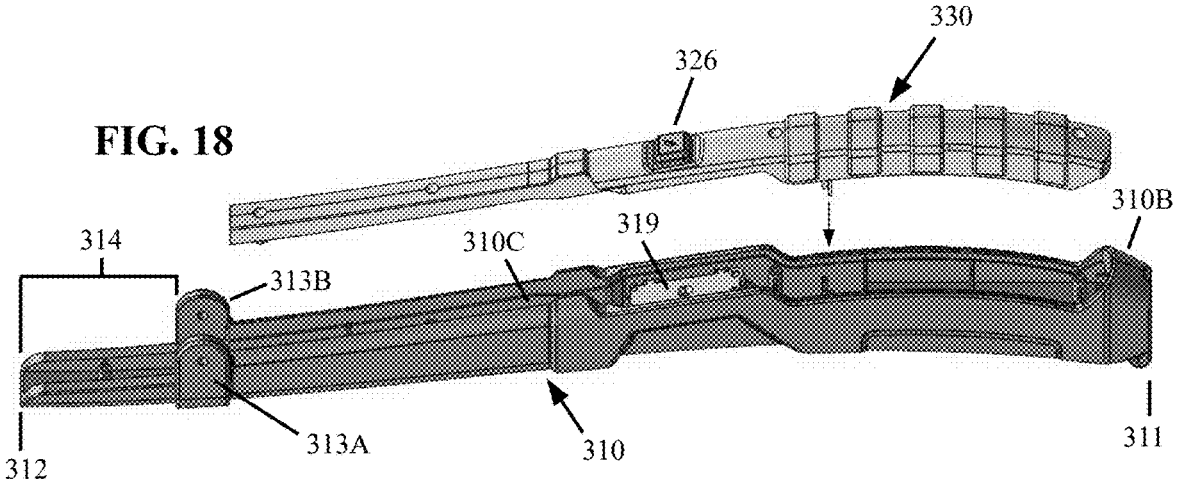
FIG. 18 is a side perspective view showing the two component parts that may be secured together to form the other of the two arms of the ball throwing device of FIG. 14, which include a graspable handle.

As may be seen in FIG. 18, the first arm member 310 may generally be shaped as a channel section 310C that may extend from a first end 311 towards a second end 312, and may have a circumferential band 310B formed at or near the first end. The channel section 310C may be formed to include at least one hinge knuckle in proximity to the second end 312, and may more preferably include two hinge knuckles, 313A and 313B, which may furthermore extend around the periphery of the part to form a protruding stop 313C (see e.g., FIG. 31A). The channel section 310C of the first arm member 310 may transition between the hinge knuckle(s) and the second end 312 into a shallower cross-sectional shape that may be formed to serve as a selectively shaped prong 314 (discussed hereinafter), as it is positioned beyond the hinge. An electrical switch 319 may be positioned within the channel section 310C. Proximate to the first end 311 of the channel section 310C, a battery compartment 322 may be formed that may be accessible through the opening provided by the circumferential band 310B (FIG. 22), which opening may be releasably covered using a battery access door 323 that may have a hinge 324 to pivotally mount to the channel section 310C. Terminals to transmit current from batteries that may be housed in the battery compartment 322 may be electrically coupled to the switch 319.

Figure 19:
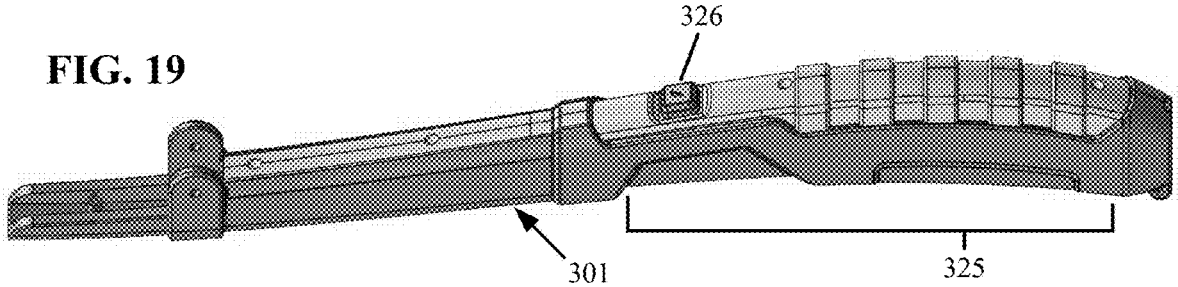
FIG. 19 is the side perspective view of FIG. 18, shown just after the two parts have been mated together.
Figure 22:
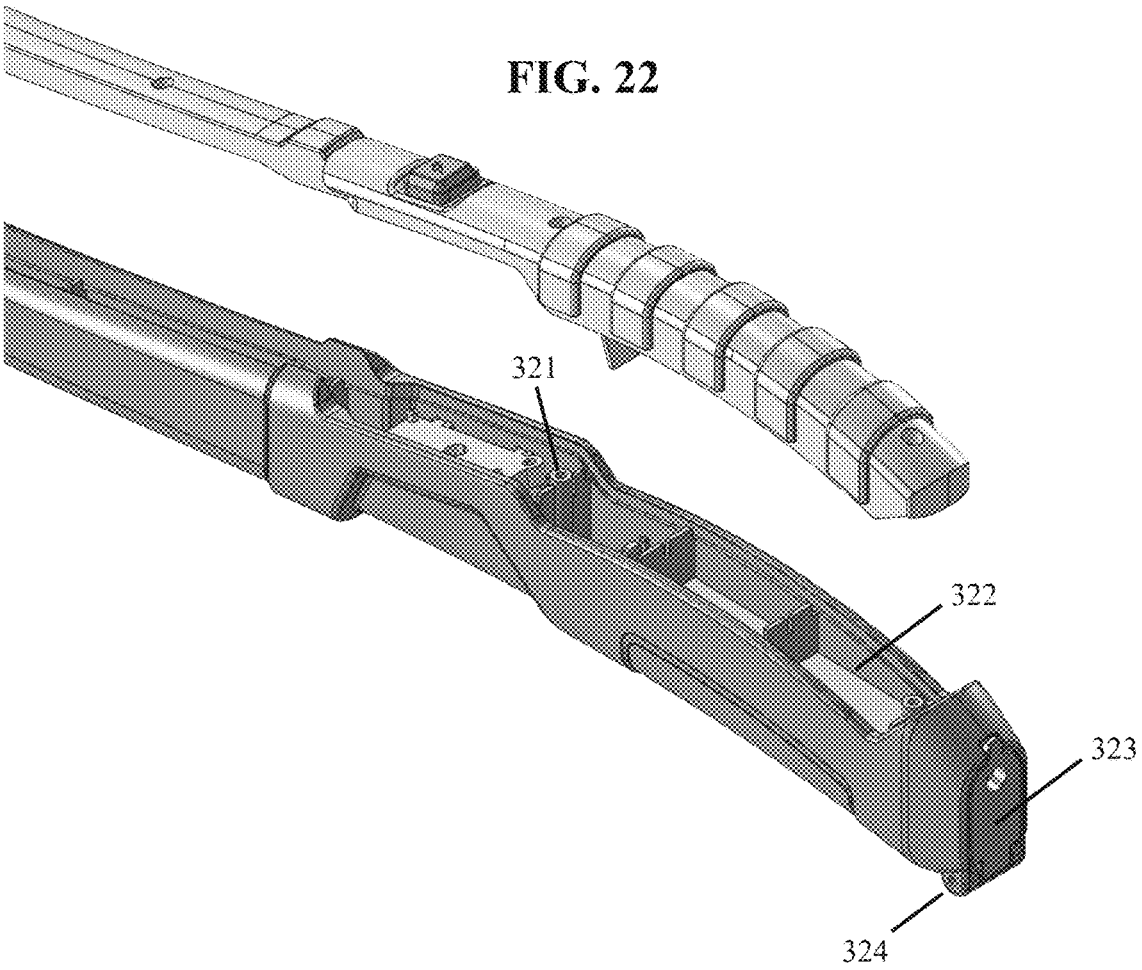
FIG. 22 is an enlarged top perspective view showing the graspable handle portion of the two component parts shown in FIG. 18, and showing the hinged battery compartment door.
Figure 23:
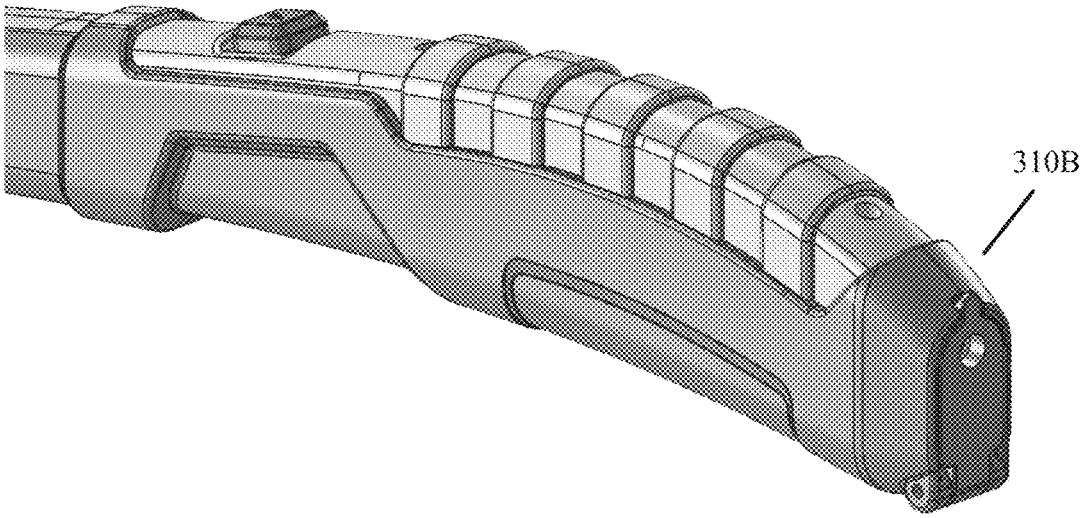
FIG. 23 is the enlarged top perspective view of FIG. 22, but shown after the two parts have been mated together.
Figure 31:
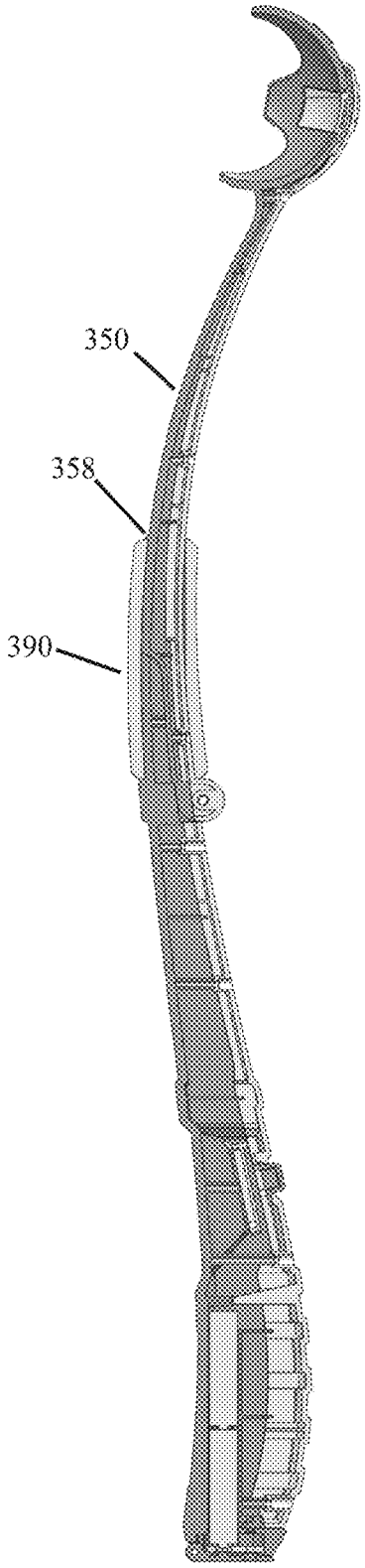
FIG. 31 is a cross-sectional view through the ball launching device of FIG. 14.

The arm cover 330 is shaped to match, and be secured to, the channel section 310C, as seen in FIG. 19, to form the arm assembly 301, and may be secured thereto in any suitable manner, e.g., using flush-head screws 99 (FIG. 14) that may be secured into hollow posts 321 formed in the channel section 310C, or using protrusions formed on the channel section 310C that may be received into the hollow posts either being snapped or glued therein, or maintained in a friction fit (see, FIG. 22 and FIG. 31). Together, the joined channel section 310C and arm cover 330 (FIG. 19) in proximity to the first end 311 may form a graspable handle region 325. The arm cover 330 may be configured to receive and slidably support a button 326 that is configured to be toggled, whereby the switch 319 may be activated by depressing of the button to energize light sources that may be used to light charge a glow-in-the-dark ball. The button 326 may protrude from the graspable handle region 325 and be ergonomically positioned to permit actuation of the button by a user's thumb while the user is simultaneously holding a portion of the graspable handle between the palm and the other four fingers.

As may be seen in FIG. 18, the second arm member 350 may similarly have a portion be generally shaped into a channel section 350C that may extend from a first end 351 at least part-way to a second end 352 of the second arm member, The second arm member 350 may be formed to include at least one hinge knuckle in proximity to the first end 351, which may pivotally couple to the at least one hinge knuckle of the first arm member 310 (i.e., forming a single shear hinge joint) or may thus alternatively include two hinge knuckles, 353A and 353B that pivotally couple to the pair of hinge knuckles, 313A and 313B of the first arm member 310 (i.e., forming a double-shear hinge joint). The first end 351 of the second arm member 350 may be formed to include a selectively shaped recess 354 that may correspond to the selectively shaped prong 314 of the first arm member 310, as described hereinafter.

Figure 17:
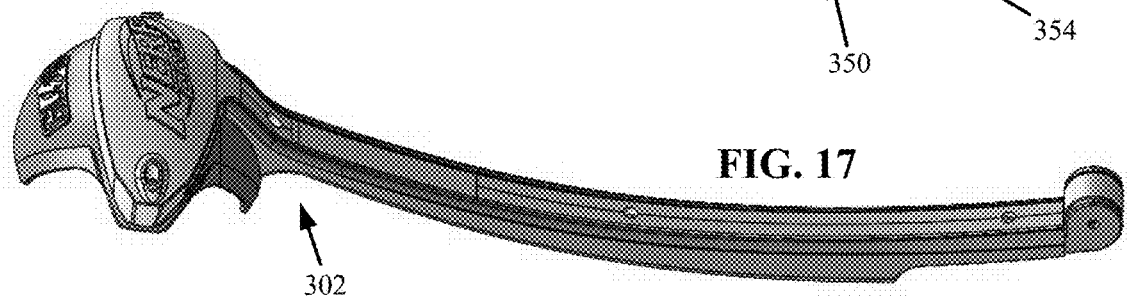
FIG. 17 is the side perspective view of FIG. 16, shown just after the two parts have been mated together.

The arm cover 370 is shaped to match, and be secured to, the channel section 350C, to form an arm assembly 302, as seen in FIG. 17, and similarly may be secured thereto in any suitable manner, e.g., using flush-head screws 99 secured into posts 356 formed in the channel section 350C (FIG. 22). The first end 371 of the arm cover 370 may also be formed to include a lug 373 that may nest between the hinge knuckles 353A and 353B to prevent clamp up, as shown in FIG. 17.

Figure 20:
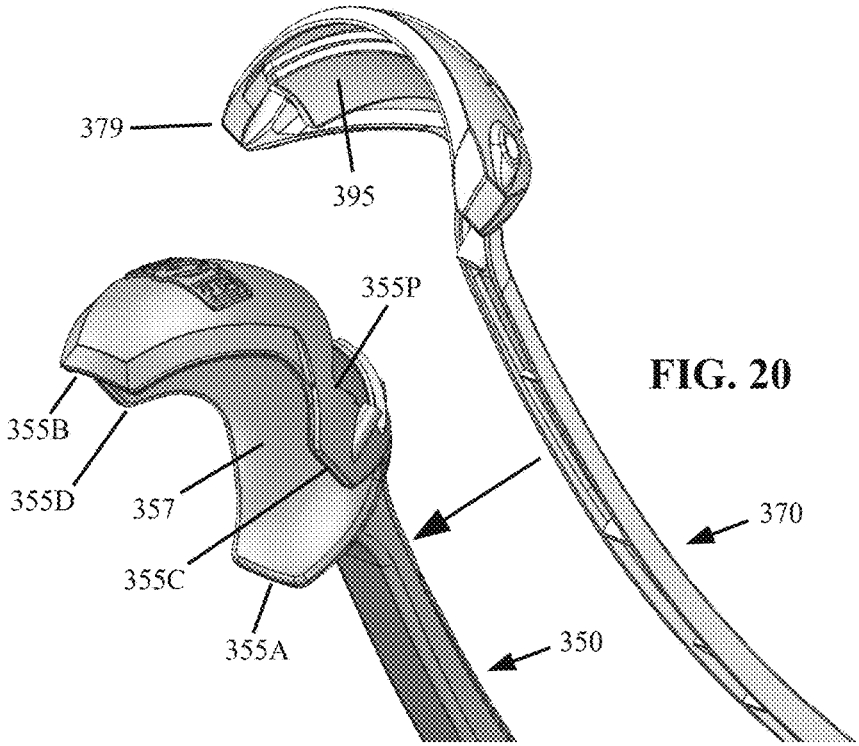
FIG. 20 is an enlarged front perspective view of the ball holder portion of the two parts shown in FIG. 16.
Figure 21:
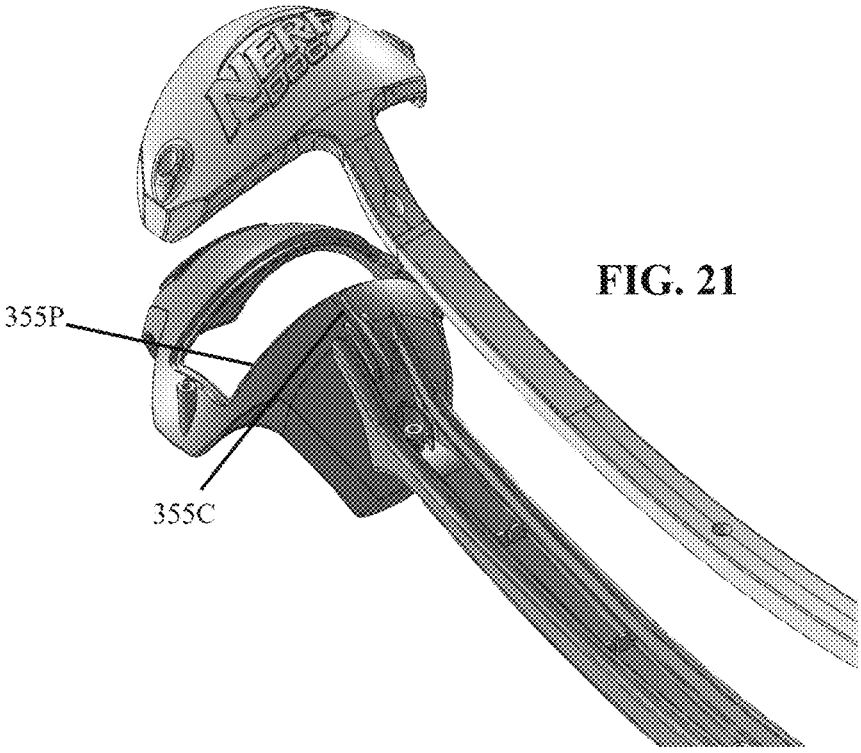
FIG. 21 is an enlarged rear perspective view of the ball holder portion of the two part shown in FIG. 16.

The second arm member 350 may be formed to include a ball holder 355 proximate to the second end 352. The channel section 350C may transition into the ball holder 355. The ball holder 355 may be formed with an interior surface 357 that may be configured to match a portion of a spherical shape of the ball, such that a size and a shape of the interior surface is configured to retain the ball received therein in a friction fit. The interior surface 357 may therefore extend slightly greater than 180 degrees of arc. The ball holder 355 may be scalloped to form a plurality of finger regions (e.g., four finger regions 355A, 355B, 355C, and 355D) that may be configured to retain the ball therein in the friction fit, even when inverted with the ball throwing device 300 being held such that the interior surface 357 is facing down towards the ground. A plurality of light sources configured to light charge a glow-in-the-dark ball may be positioned within a recess in the ball holder 355. The plurality of light sources may be light emitting diodes (LEDs), and may also be formed into an LED strip 395. For ease of manufacturing, the arm cover 370 may be formed with a transversely oriented arcuate member 379 at its second end 372, which may be used to support the LED strip 395, as shown in FIG. 20, which strip may be protrude into a portion of a thru-opening 355P in the ball holder 355. The LED strip 395 may extend from proximity to a distal end of a first one of the plurality of finger regions (e.g., finger 355C) to proximity to a distal end of a second of the plurality of finger regions (e.g., finger 355D), to thereby produce a plurality of different (non-parallel) axes of light that create a dispersion of light directed into various different portions of the ball, to more effectively light charge a greater portion of the ball and which light-charging may be accomplished in a shorter period of time (see FIG. 7).

Figure 24:
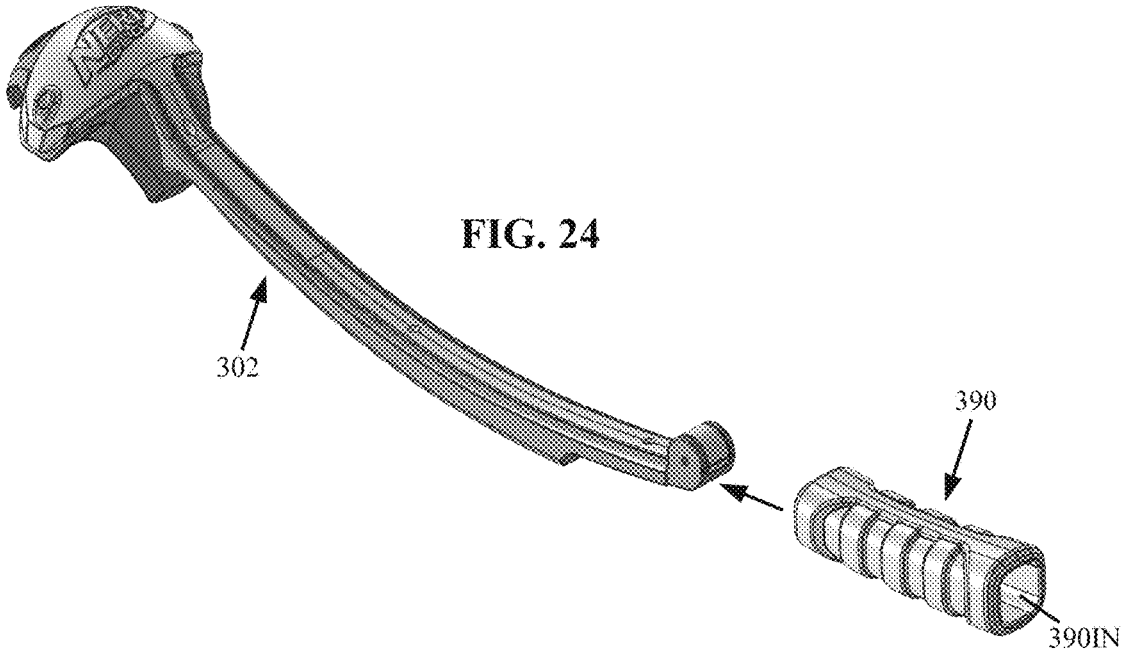
FIG. 24 is a perspective view showing the assembled arm of FIG. 17 just prior to sliding of the sleeve thereon.

Assembly of the ball throwing device 300 may next include sliding of the sleeve 390 onto the arm assembly 302, as indicated in FIG. 24. The cross-sectional shape of the joined arm member 350 and arm cover 370 of the second arm assembly 302 may neck down (i.e., grow progressively smaller) towards the ball holder 379. Also, the cross-sectional shape of the second arm assembly 302 proximate to the hinge knuckles 353A and 353B may already be smaller due to the recess 354 formed thereat, each of which may generally be smaller than the cross-section interior envelope 390IN of the sleeve 390, so that the sleeve may readily slide thereon (see FIG. 25).

Figure 25:
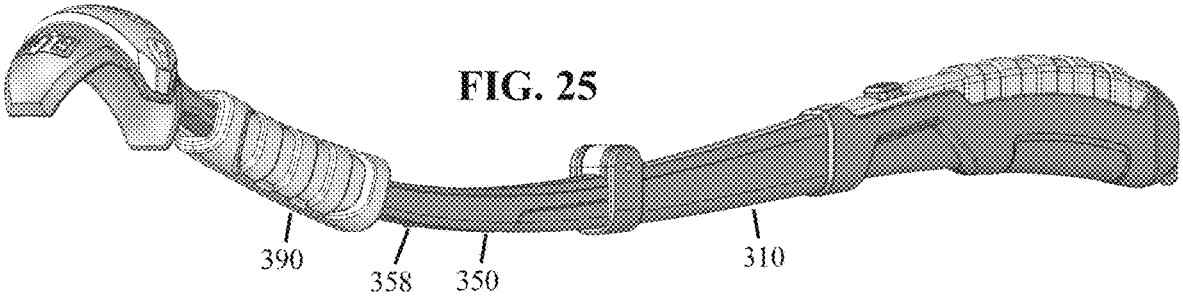
FIG. 25 is a perspective view showing the assembled arm of FIG. 24 after sliding of the sleeve thereon, and after the two arms have been pivotally coupled together.
Figure 26:
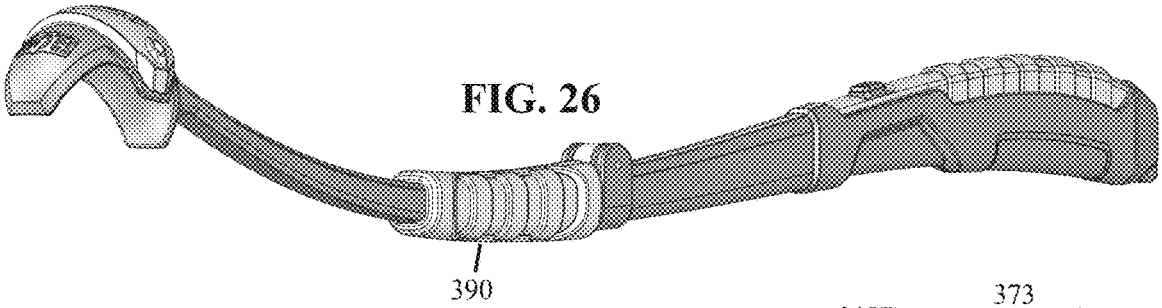
FIG. 26 is the perspective view of FIG. 25, shown after the sleeve has been slid into frictional engagement with at least a portion of a selectively shape prong of the first arm and an adjacent portion of the second arm, at a position being proximate to the pivotally coupled hinge knuckles.
Figure 27:
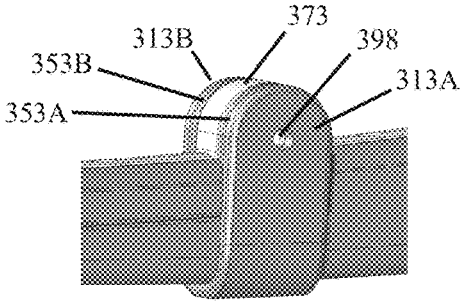
FIG. 27 is an enlarged detail view of the joined hinge knuckles shown in FIG. 26.
Figure 28:
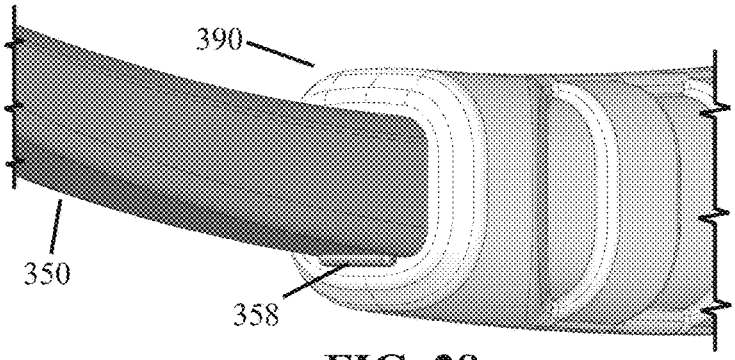
FIG. 28 is a perspective view of a protrusion that protrudes from the second arm member, and which is configured to releasably retain the sleeve over the hinge joint, to prevent inadvertent pivoting of the device into the collapsed position.
Figure 29:
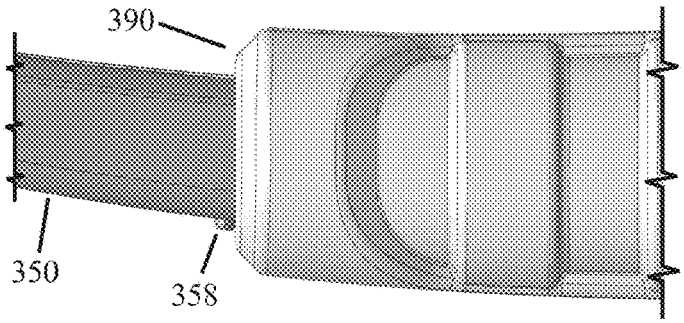
FIG. 29 is a side view showing the protrusion that protrudes from the second arm member, as seen in FIG. 28.
Figure 30:
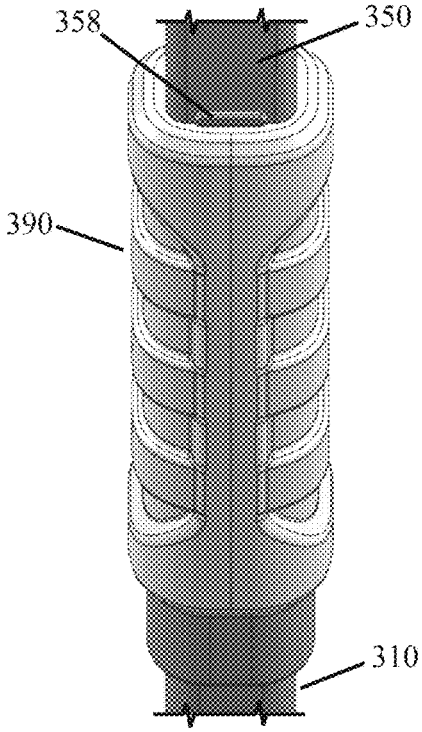
FIG. 30 is a front perspective view showing the protrusion that protrudes from the second arm member, as seen in FIG. 28.
Figure 32:
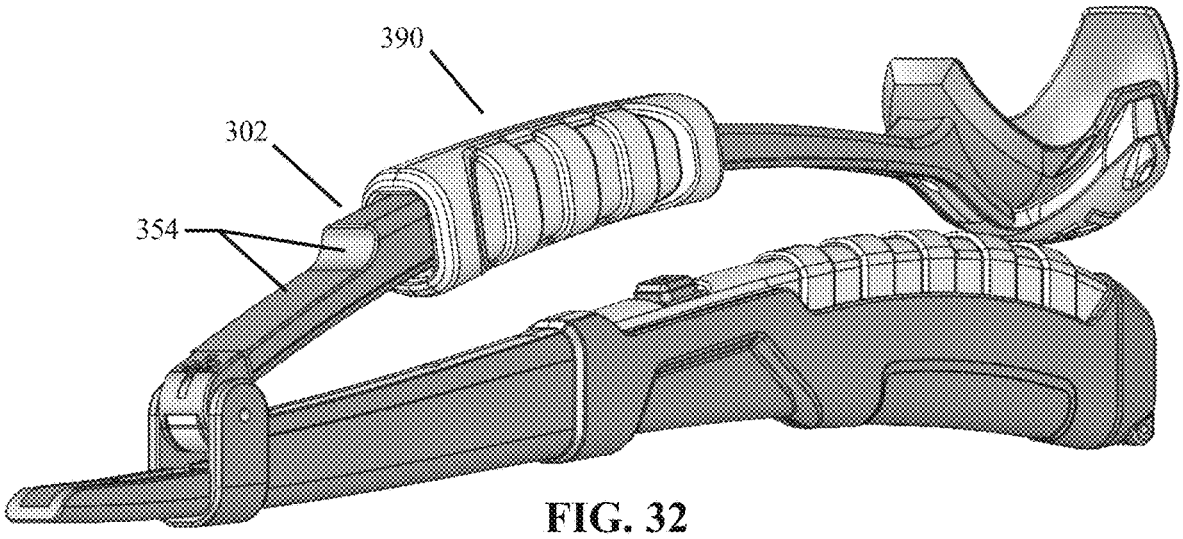
FIG. 32 is a first perspective view showing the ball launching device of FIG. 14, after the first arm has been pivoted into the collapsed position.
Figure 33:
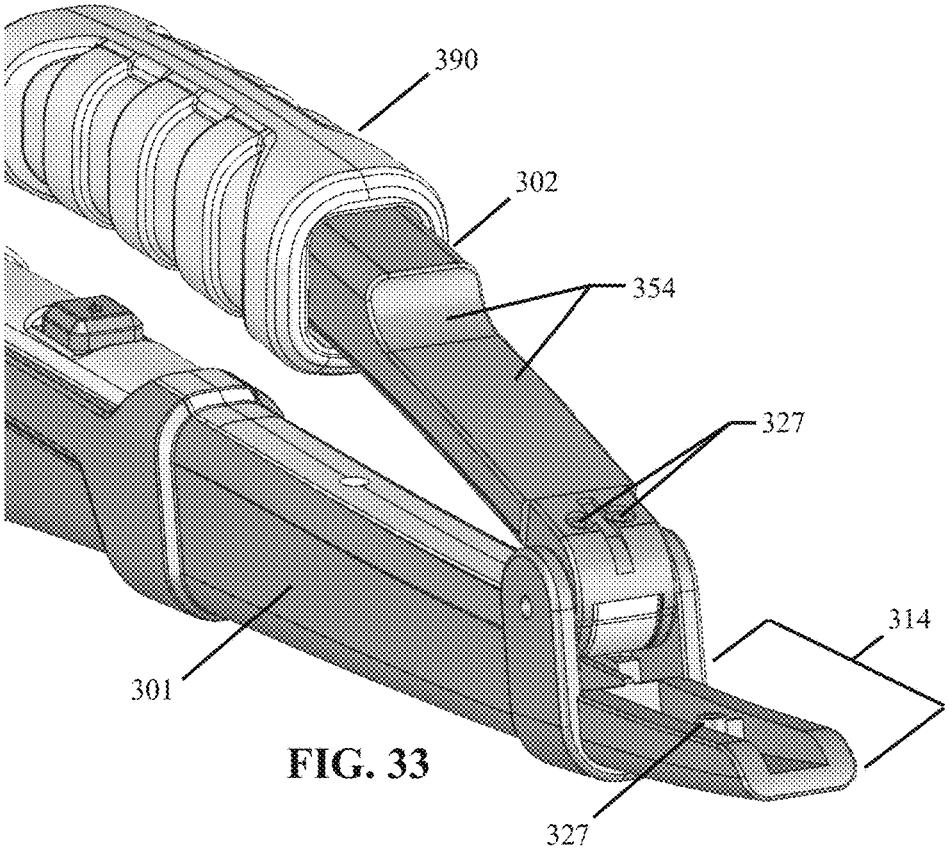
FIG. 33 is a second perspective view showing the ball launching device of FIG. 14, when in the collapsed position.

Assembly of the ball throwing device 300 may next include pivotally coupling of the hinge knuckle(s) of the arm assembly 302 to the hinge knuckle(s) of the arm assembly 301 using at least one hinge pin 398, as shown in FIG. 25 and FIG. 27, and may create either a single-shear hinge joint or a double-shear hinge arrangement. Being so coupled together, the second arm assembly 302 may pivot with respect to the first arm assembly 301 between an extended position (FIG. 25) and a collapsed position (FIG. 32 and FIG. 33). It may be seen by comparing FIG. 32 and FIG. 25, that when the second arm assembly 302 is pivoted with respect to the first arm assembly 301 into the extended position, the selectively shaped prong 314 of the first arm member 310, having a shape being complementary to a shape of the selectively shaped recess 354 of the second arm member 350, will thereby nest within the recess so that the two arms form a generally continuous cross-sectional shape.

Figure 31A:
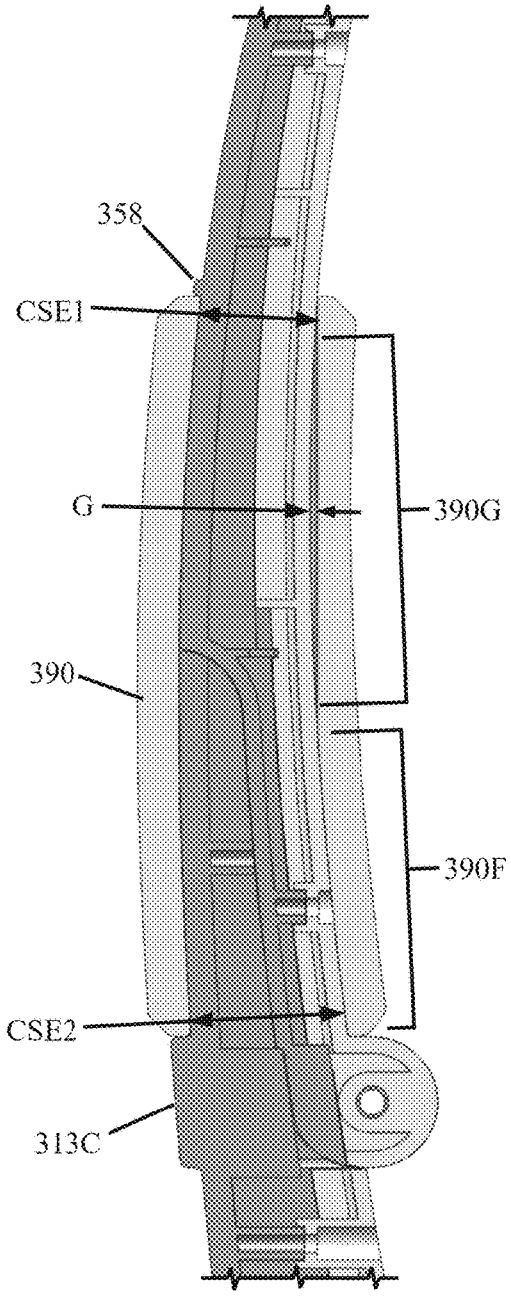
FIG. 31A is an enlarged detail portion of the cross-sectional view of FIG. 31.

When the second arm assembly 302 is rotated into the extended position, the exterior surfaces of the combined cross-sectional shape of the nested selectively shaped prong 314 of the first arm member 310 and the adjacent portion of the second arm member 350 may be such that when the sleeve is slid to overlay those surfaces, at least portion (e.g., at 390F) may be engaged therewith in a friction fit at a position that may be proximate to the hinge knuckle. Additionally, or alternatively, the sleeve 390 may be maintained in the secured pivot-inhibiting position shown in FIG. 26 (and FIGS. 31 and 31A) using a protrusion 358. The protrusion 358 may protrude from the second arm member and is configured (sized and shaped) to releasably retain the sleeve over the hinge joint, to prevent unintended movement of the sleeve as a result of energetic ball throwing that may otherwise overcome the friction fit, and thus prevent undesired pivoting of the device into the collapsed position. The sleeve 390 may deform elastically as it is slid across the protrusion 358, and may thereafter be trapped between the protrusion 358 and the stop 313C and/or the hinge knuckles, particularly where a constant cross-sectional shape may be used. However, as may best be seen in FIG. 31A, the combined cross-sectional extent CCE1 of the first arm 301 and second arm 302 being proximate to the protrusion 358 may be formed to be narrower than the combined cross-sectional extent CCE2 proximate to the hinge knuckles, so the interior surface of the sleeve may easily slide over the protrusion, until the narrower end of the sleeve approaches the protrusion 358. As such, there may be a gap at region 390G between the sleeve 390 and the second arm 302, as seen in FIG. 31A. The gap G may taper downward towards the ends of the region 390G, being at a maximum in the middle of the gap region.

Wiring from the LED strip 395 may run through a channel 355C on the back side of the ball holder 355 (FIG. 21) into the channel 350C of the second arm member 350 and across the hinge as described hereinabove and through the channel section 310C of the first arm member 310 and be electrically couple to the terminals in the battery compartment 322 through the switch 319.

An alternative structural arrangement may be used for accomplishing electrical connectively across the hinge joint. As seen in FIG. 33, a pair of electrical pins 327 may be electrically coupled to the LED strip 395, and which pins may be further configured to protrude within an opening in the selectively shaped recess 354, and a corresponding pair of electrical receptacles 328 may be positioned in the selectively shaped prong 314, which receptacles may be electrically coupled to the switch 319. As such, it may be seen in FIG. 33 and understood from FIG. 25, that when the second arm assembly 302 is pivoted with respect to the first arm assembly 301 from the collapsed position into the extended position, the pair of electrical pins 327 are received within, and electrically coupled with respect to, the pair of electrical receptacles 328.

The switch 319 and button 326 may be configured to co-act such that the circuit is only complete while the button is depressed, and charging will only occur so long as the user holds the button down in a depressed position. Alternatively, the switch 319 may be configured to be turned on by initially toggling of the button 326, and may be further configured to be turned off by subsequently toggling of the button a second time, so that the lights remain on to charge the ball until the button is toggled for that second time. In yet another embodiment, as noted above, the switch 319 may be coupled to the timer to thereby be configured to energize the plurality of light sources for a threshold period of time after the button 326 is toggled, which only needs to be toggle once.

Figure 34:
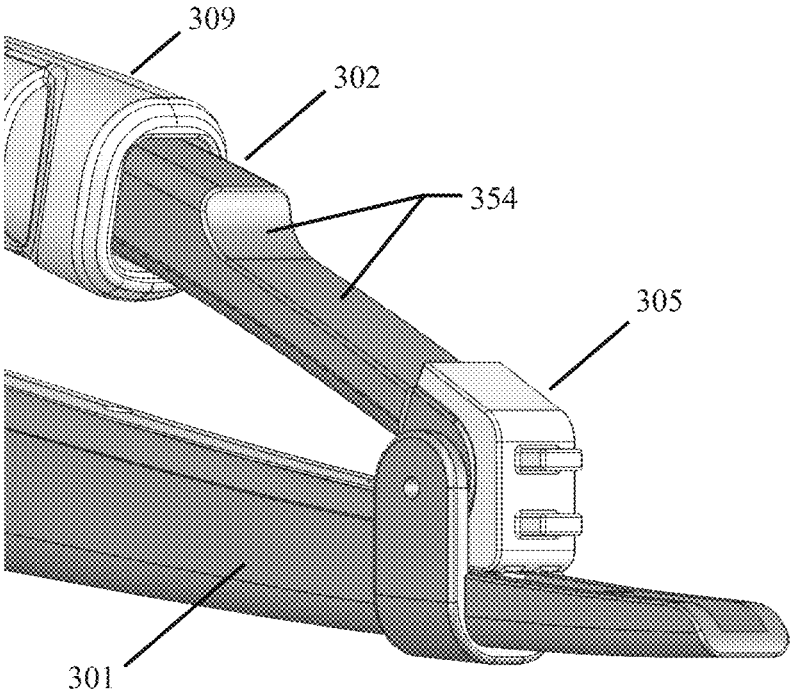
FIG. 34 is the perspective view of FIG. 33, but additionally showing use of a bridge member configured with two metal strip that make contact with the metal contact pins of the first arm and the metal contact pins on the second arm, to allow current to flow therebetween when the device is in the collapsed position, and those pairs of pins are not directly coupled together as when in the extended position.
Figure 35:
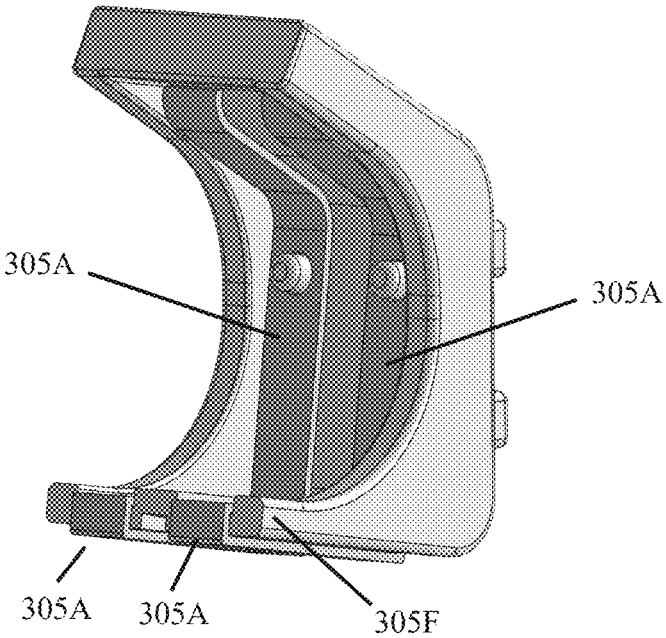
FIG. 35 is an enlarged detail view showing the two strips of the bridge member of FIG. 34.
Figure 36:
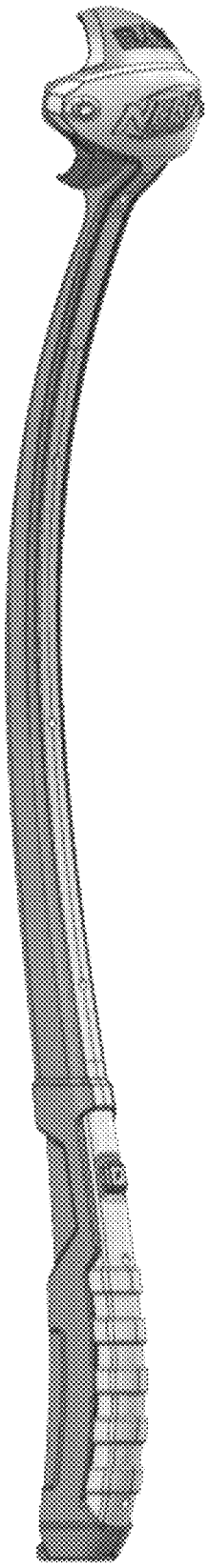
FIG. 36 is a perspective view of a ball launching device similar to the device of FIG. 14, but which eliminates the hinge arrangement and requires fewer parts.
Figure 37:
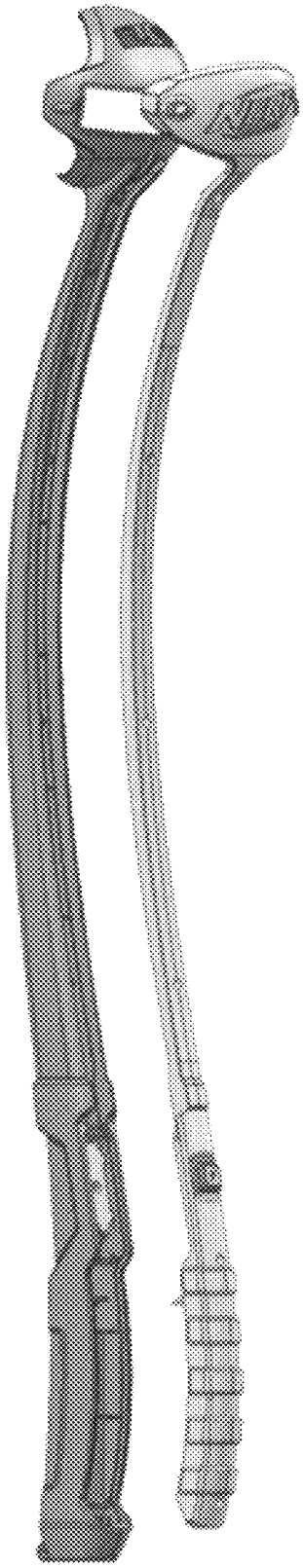
FIG. 37 is an exploded perspective view showing the main component parts that may be used to form the ball throwing device of FIG. 32.

As it may also be beneficial to use the plurality of lights of the ball throwing device 300 while in the collapsed position of FIG. 32 without the ball being positioned in the ball holder 355 for other purposes (e.g., as a lamp, or when the device is being displayed in a retail store environment), a bridge 305 may be utilized to complete the electrical connections across the hinge arrangement. The bridge 305, as seen in use in FIG. 34 and as shown in greater detail in FIG. 35, may be formed to include a first electrical strip 305A and a second electrical strip 305B. The first and second electrical strips 305A and 305B of the bridge 305 may be configured to contact the electrical pins 327 of the arm assembly 301, and electrical receptacles 328 of the arm assembly 302, when the bridge is installed, as shown in FIG. 35. One of the flanges of the bridge, i.e., flange 305F, may be sized and shaped to slide between a portion of the first arm assembly 301 and the second arm assembly 302, proximate to the hinge knuckles, in a slight interference fit, as seen in FIG. 34.

It is noted that the plurality of light sources, the switch 319, the button 326, the electrical wiring and connections, and the battery compartment may be sealed sufficiently to waterproof the device for operation in rainy weather, and may even submersible to a shallow depth.

While illustrative implementations of one or more embodiments of the disclosed system are provided hereinabove, those skilled in the art and having the benefit of the present disclosure will appreciate that further embodiments may be implemented with various changes within the scope of the disclosed system. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

The invention claimed is:

1. A ball throwing device comprising:

a first arm member;

a second arm member;

a sleeve;

wherein said first arm member has a first end and a second end, and comprises:

a graspable handle formed at said first end;

at least a first hinge knuckle formed in proximity to said second end; and a selectively shaped prong configured to extend away from said at least a first hinge knuckle towards said second end, and terminates at said second end;

wherein said second arm member has a first end and a second end, and comprises:

at least a first hinge knuckle formed at said first end;

a ball holder formed at said second end; and a selectively shaped recess formed in proximity to said at least a first hinge knuckle of said second arm;

wherein said at least a first hinge knuckle of said first arm is pivotally coupled to said at least a first hinge knuckle of said second arm, said first arm thereby configured to pivot with respect to said second arm between a collapsed position and an extended position;

wherein said selectively shaped prong of said first arm comprises a shape being complementary to a shape of said selectively shaped recess of said second arm, to thereby nest together, when said second arm is in said extended position;

wherein said sleeve is slidably mounted on said second arm, and is configured to slide from a first position, into a second position to overlay at least a portion of said selectively shape prong of said first arm and an adjacent portion of said second arm; and a protrusion formed on a portion of said second arm, said protrusion configured to releasably secure said sleeve against inadvertent movement when at said second position.

2. The ball throwing device according to claim 1, wherein said ball holder comprises:

an interior surface configured to match a portion of a spherical shape of the ball; and wherein a size and a shape of said interior surface is configured to retain the ball received therein in a friction fit.

3. The ball throwing device according to claim 2, wherein said interior surface extends greater than 180 degrees of arc.

4. The ball throwing device according to claim 3, wherein said ball holder is scalloped to form a plurality of finger regions configured to retain the ball therein in a friction fit, when inverted with said interior surface facing down towards the ground.

5. The ball throwing device according to claim 4, further comprising:

a battery compartment configured to store one or more batteries;

a plurality of light sources configured to light charge a glow-in-the-dark ball.

6. The ball throwing device according to claim 5, wherein said battery compartment is formed in said graspable handle.

7. The ball throwing device according to claim 6, wherein said plurality of light sources are light emitting diodes (LEDs).

8. The ball throwing device according to claim 7, wherein said plurality of LEDs are positioned within a recess formed in said ball holder.

9. The ball throwing device according to claim 8, wherein said plurality of LEDs extend from proximity to a distal end of a first one of said plurality of finger regions to proximity to a distal end of a second of said plurality of finger regions, to thereby to produce a plurality of different axes of light to create a dispersion of light direct into various different portions of the ball.

10. The ball throwing device according to claim 9, further comprising:

a button;

a switch configured to activated by depressing of said button to energize said LEDs to light charge the ball.

11. The ball throwing device according to claim 10, wherein said button is configured to protrude from said graspable handle and be ergonomically positioned in said graspable handle to permit actuation of said button by a user's thumb while simultaneously holding a portion of the graspable handle between the palm and the other four fingers.

12. The ball throwing device according to claim 11, further comprising:

a pair of electrical pins configured to protrude from said prong, and being electrically coupled to said switch;

a pair of electrical receptacles positioned in said selectively shaped recess, and being electrically coupled to said plurality of light sources; and wherein said pair of electrical pins engage within said pair of electrical receptacles when said selectively shaped prong is nested together with said selectively shaped recess, when said second arm is in said extended position.

13. The ball throwing device according to claim 12, further comprising:

a timer;

wherein said switch is coupled to said timer to thereby be configured to energize said plurality of light sources for a threshold period of time after said button is toggled.

14. The ball throwing device according to claim 12, wherein said switch is configured to be turned on by toggling of said button, and said switch is configured to be turned off by subsequently toggling of said button a second time.

15. The ball throwing device according to claim 12, wherein said switch is configured to be turned on only when said button is maintained in a depressed position.

16. The ball throwing device according to claim 12, wherein said plurality of light sources, said switch, said button, and electrical connections between said switch and said plurality of light sources are waterproof.

* * * * *